US005533715A

United States Patent [19]

Dandrea

[11] Patent Number: 5,533,715

[45] Date of Patent: Jul. 9, 1996

[54] CHILD'S SAFETY BARRIER FOR RAILING SYSTEMS

[76] Inventor: Tamara H. Dandrea, 5996 Wescott Hills Way, Alexandria, Va. 22315

[21] Appl. No.: 293,070

[22] Filed: Aug. 19, 1994

[51] Int. Cl.[6] ..... A47C 21/08; E04H 17/00

[52] U.S. Cl. ..... 256/45; 5/100; 160/351; 256/24; 256/57

[58] Field of Search ..... 5/100, 424, 425, 5/512; 160/327, 351, 354, 368.1; 256/1, 24, 29, 45, 57

[56] References Cited

U.S. PATENT DOCUMENTS

| | | | |
|---|---|---|---|
| 2,742,391 | 4/1956 | Warp | 256/1 X |
| 3,050,287 | 8/1962 | Bloch et al. | 256/24 |
| 3,273,862 | 9/1966 | Miller | 256/24 X |
| 3,494,596 | 2/1970 | Bellinson et al. | 256/24 |
| 3,672,638 | 6/1972 | Krebs | 256/12.5 |
| 4,576,364 | 3/1986 | O'Fearna | 256/24 |
| 4,852,194 | 8/1989 | Langan | 5/427 |
| 5,076,545 | 12/1991 | Bodzin | 256/1 |
| 5,152,508 | 10/1992 | Fish | 256/24 |
| 5,358,025 | 10/1994 | Wood | 160/368.1 |
| 5,407,178 | 4/1995 | Long | 256/45 |
| 5,460,409 | 10/1995 | Conner | 160/327 X |
| 5,465,941 | 11/1995 | Abbott | 256/45 X |

FOREIGN PATENT DOCUMENTS

| | | | |
|---|---|---|---|
| 991925 | 6/1976 | Canada | 256/24 |

*Primary Examiner*—Kenneth J. Dorner
*Assistant Examiner*—Andrea Chop

[57] ABSTRACT

A safety barrier for railing systems for preventing entrapment, serious injury or death resulting from bodily penetration through the baluster support members of a railing system. The barrier substantially covers the horizontal space between vertical support members and the vertical space equal to the height of the balusters by weaving a mesh scrim or web of poly-vinyl-chloride in primary form plasticized between and along the balusters resulting in taut coverage of the open spacing. A border fabricated of reinforced nylon, canvas or like material is joined to each end of the barrier, having a plurality of openings to allow a means for tightly securing the barrier to an end wall, post or any combination thereof. The barrier is adaptable to lesser dimensions in terms of length and height.

16 Claims, 4 Drawing Sheets

CHILD'S SAFETY BARRIER FOR RAILING SYSTEMS

References Cited

United States Patent Documents

| | | |
|---|---|---|
| 5,076,545 | 12/1991 | Bodzin |
| 4,852,194 | 8/1989 | Langan |

BACKGROUND OF THE INVENTION

The present invention relates generally to the protection of railing systems, and more particularly to a child's safety barrier for railing systems designed with baluster-type support members that left unguarded, lure and threaten small children with entrapment, serious injury and even death should the child successfully penetrate all or part of the body through the unprotected, adjacent balusters.

It is well known that young children are highly attracted to stairs and the railing systems meant to protect them from danger. Particularly of interest to the child are the vertical members which support the hand rail and are typically anchored to a bottom rail or floor, otherwise known as balusters. Balusters are spaced laterally and by regulated construction codes are a specified distance apart. Enticed by the open spacing, small children will attempt passage through the balusters, often injuring parts of their body or falling to serious harm.

The U.S. Pat. No. 4,852,194, by Langan, issued on August 1989, addresses the problem by offering a safety guard for railing systems, having as its basic element a panel of flexible nylon netting material with a heavy duty nylon binding around the periphery of the panel which is installed across the baluster openings and tied with nylon cording threaded through predetermined and regularly spaced openings to the top and bottom railings. In the event no bottom rail exists, the nylon cording must be tied around the base of the baluster, specifically the area in which the vertical baluster meets the horizontal plane of the flooring, or the cording is threaded through screw eyes and anchored to the floor.

This design however, displays the drawback that the material of flexible nylon netting, when installed in combination with the nylon cord ties, has the inherent ability to stretch from its original shape and slip out of place, resulting in an escape opening for a child. Nylon cording, when tied to the top and bottom railings, provides a degree of movement around the railing which further allows the netting device to become stretched out and easily manipulated, particularly by small children. Screw eyes provided with Langan's device must be mounted to the floor and pose a threat of injury should a child's extremities get caught or snagged while playing near the railing.

The U.S. Pat. No. 4,852,194 as filed, clearly recognizes the drawbacks of a flexible netting by stating support for the installation of a sub-panel or plate of metal, wood or plastic to "keep the main panel from sliding or otherwise moving away from the end portion of the supporting structure, which would result in an escape hole or opening, thereby defeating the primary purpose of the barrier." (1) It would be obvious to one skilled in the art that such device was designed to be effective with the proper installation of the aforementioned sub-panel however, research shows the sub-panel is omitted from the manufacturing process today.

(1) Langan U.S. Pat. No. 4,852,194, Column 3, lines 3–14; Column 3, lines 50–53; Column 4, lines 30–40.

The U.S. Pat. No. 5,076,545 by Bodzin, issued December 1991, offers a child's banister guard of rigid panels of plexiglass. Each panel is adjustably juxtapositioned with an adjacent panel and secured horizontally across baluster openings by cording woven in and around each adjacent baluster through a periphery of punched holes at the top and bottom of each panel. This design however, displays the drawback that the edges are coarse, even sharp, as they are not finished with a form of binding and could injure a child's hands or feet while playing near the railing. Additionally, in terms of aesthetics, the guard, although marketed as clear in color, is actually a light blue tinted plexiglass. This feature detracts from the home's appeal because the device becomes unfavorably noticeable.

OBJECTS OF THE INVENTION

It is a principal object of the invention to provide an improved safety barrier that will effectively prevent children from entrapment, serious injury or death around the baluster and railing area of the home and without the objections attendant to prior art types of barriers.

Another significant object of the invention is to provide a safety barrier made of a unique, unobvious material having inherent properties to resist stretching and slipping out of place when installed, thereby eliminating a need for cord ties around the hand rail and base of the baluster; a need for cord ties threaded horizontally through a periphery of holes punched at the top and bottom of each panel; and a need for cording tied through screw fasteners mounted to the floor.

Still another object of the invention is to provide a safety barrier made of a material that will not cut or in any way injure a child's extremities when contact is made.

Still a further object of the invention is to provide a safety barrier which is adjustable in length and height to substantially cover the baluster openings of any railing system.

A further object of the invention is to provide an aesthetically pleasing alternative to guarding the railing system which is typically in a highly visible area of the home and a device which is economical to manufacture.

Further objects and advantages of the invention will become apparent from a consideration of the drawings and ensuing description.

BRIEF SUMMARY OF THE INVENTION

The present invention overcomes the aforementioned drawbacks of U.S. Pat. No. 4,852,194 and U.S. Pat. No. 5,076,545, respectively. The novel application of a polyester scrim coated with poly-vinyl-chloride in primary form plasticized or PVC coated scrim, provides an inherent non-slip property that when installed, offers a taut and effective child safety barrier without the aid of cording tied around the hand rail; without the necessity of cording tied to screw fasteners mounted to the floor; without stretching or otherwise losing its original shape; and without rigid edges that could present harm.

A border of reinforcing material is joined to the two sides having the shorter dimensions or the end borders with predetermined openings for purposes of securing the barrier to vertical support members. The use of grommets or like reinforcing method is provided for the openings in the end borders to allow straps access for positioning around posts and where necessary, anchors or like fasteners for securing the barrier to the wall.

The present invention offers adjustability in length and height, as it easily folds to the required dimension during installation and holds in place due to the inherent, slip-resistant property of the poly-vinyl-chloride. The PVC coated scrim is a mesh screen in appearance, having tiny apertures offering air passage and visibility. The barrier is easily wiped clean without removal from the railing system and is portable. The barrier can be rectangular or rhomboidal in shape, with varying lengths to secure a horizontal railing system or an inclined stair system.

BRIEF DESCRIPTION OF THE DRAWINGS

The present invention will be more fully understood by reference to the following detailed drawings, and wherein.

DETAILED DESCRIPTION OF THE INVENTION

Figure 1:
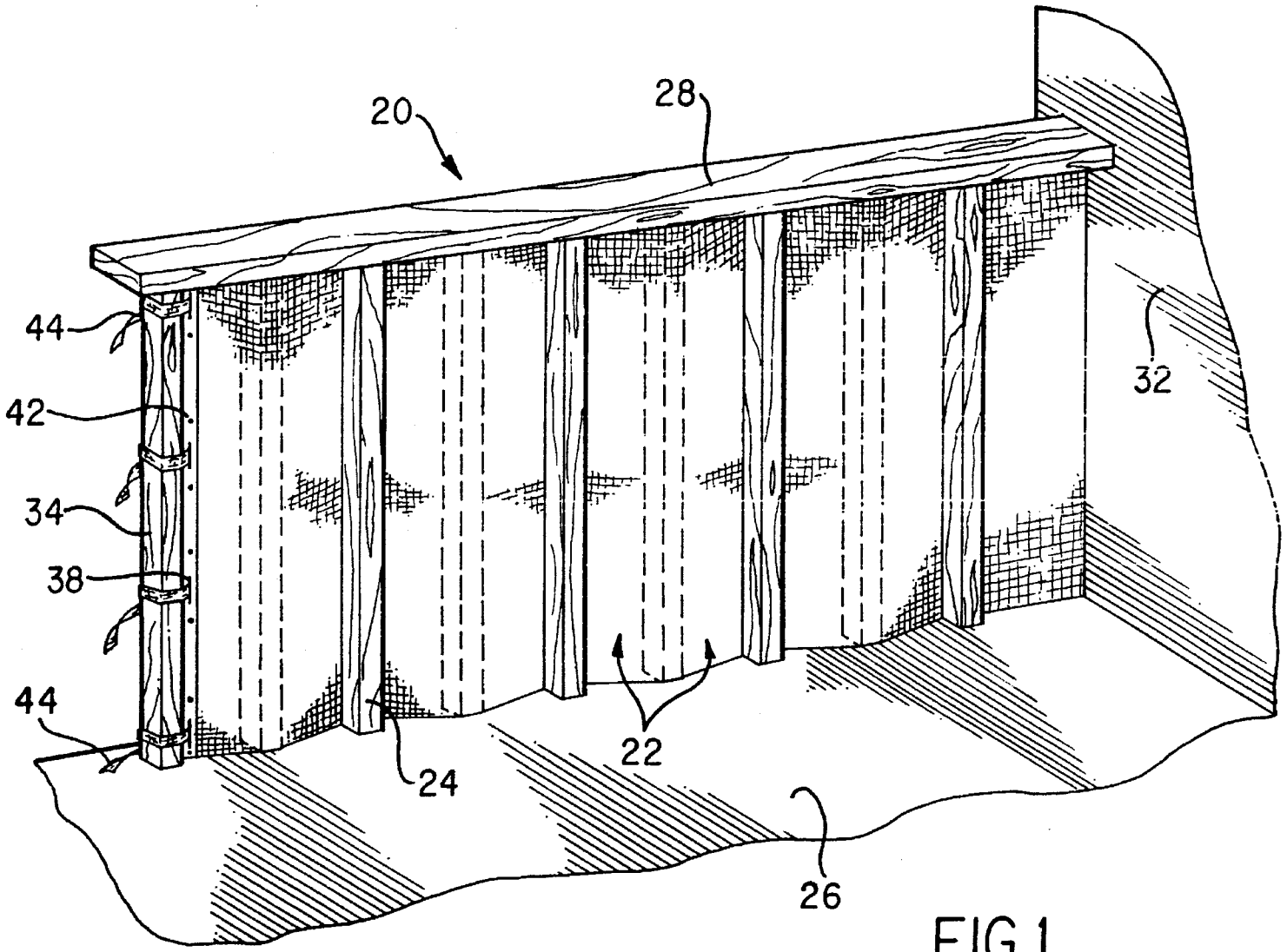
FIG. 1 is a perspective view of a preferred embodiment of the barrier installed on a typical railing system, facing a landing.

Referring to the drawings, FIG. 1 depicts a perspective view of a safety barrier 22, as it would typically be installed on a railing system 20 facing a landing whose basic configuration may comprise a plurality of vertical support members known as balusters 24 mounted to a bottom rail, not shown, or to flooring 26 and supporting a hand rail 28 which extends between two vertical end supports, specifically an end wall 32 and a post 34. It is well known that any combination of end wall 32 and post 34 may comprise the vertical end supports which flank railing system 20. However, to demonstrate the versatility and adaptability features of barrier 22 for any given combination, end wall 32 and post 34 are depicted in the drawings.

The primary feature of barrier 22 is the fabric or material from which barrier 22 is made; preferably, a thin, polyester scrim coated with poly-vinyl-chloride in primary form plasticized or PVC coated scrim. The poly-vinyl-chloride composition of barrier 22 offers a mesh screen appearance with small apertures allowing air passage and visibility. The texture of the PVC coated scrim offers a soft and sponge-like quality with a noticeable tacky property.

The advantage of this composition when barrier 22 is installed on railing system 20 will be subsequently described.

As clearly shown in FIG. 1, barrier 22 has as its basic configuration, a rectangular shape to fit horizontal railing system 20. Barrier 22 can also be configured in a rhomboid shape, not shown, to fit an inclined stair system. Barrier 22 may be fabricated in varying lengths and manufactured preferably clear or translucent or in any desired color.

Figure 2:
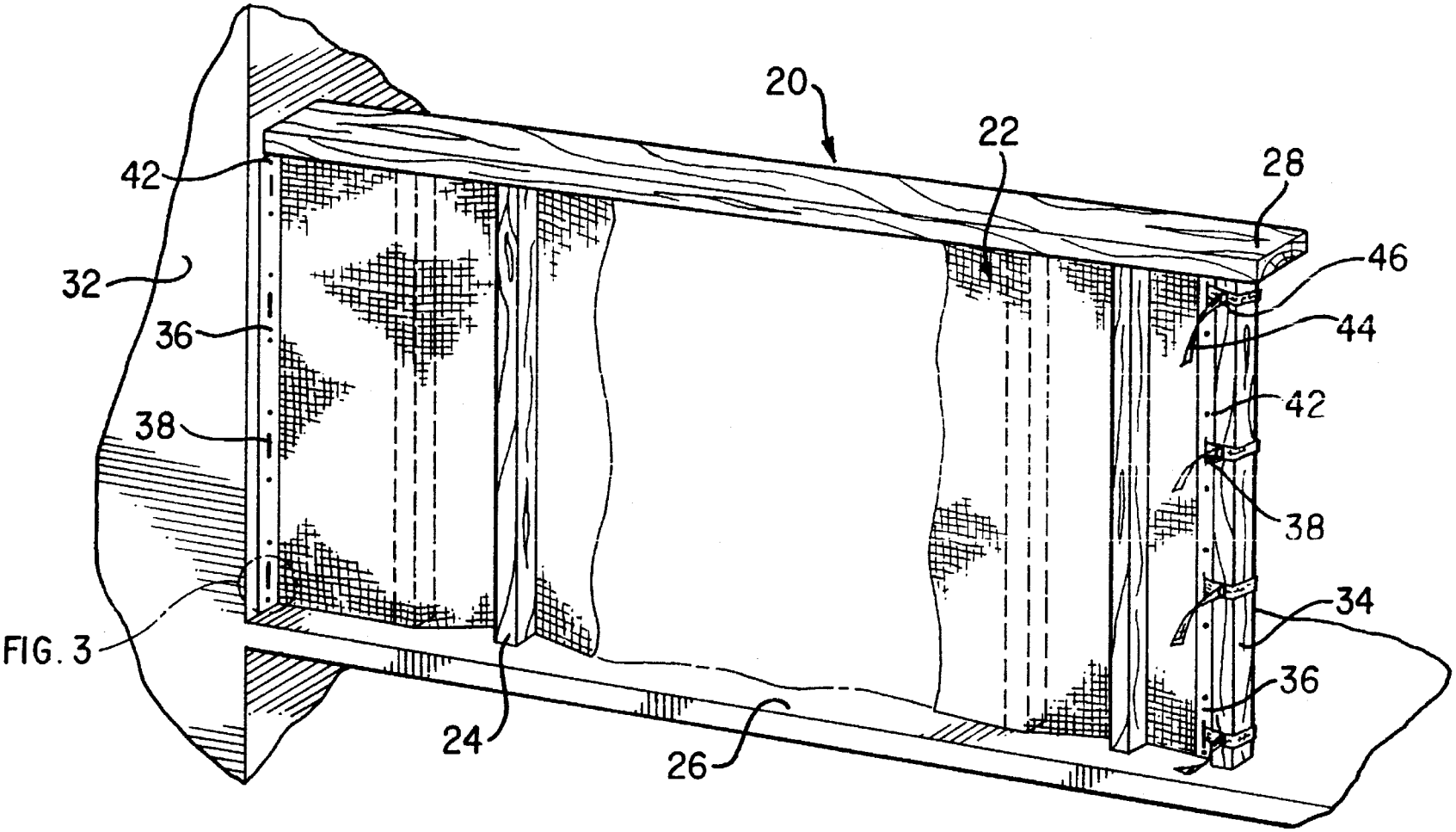
FIG. 2 is a rear perspective view facing the stairs and showing a means for securing the barrier to a wall and a post.

FIG. 2 shows the rear or back side view of railing system 20 facing the stairs with barrier 22 installed. The borders 36 of reinforced nylon, canvas or like material are double in thickness and double stitched to the shorter dimensions or ends of barrier 22 so as to provide a sandwiching effect of the PVC coated scrim between the material of border 36. Each border 36 end provides two types of openings; a buttonhole-type opening 38 reinforced by suitable thread or oblong-shaped grommets of plastic or metal, and a round or punched opening 42 reinforced by suitable thread or circular shaped grommets of plastic or metal. Buttonhole opening 38 in combination with round opening 42 are spaced consecutively and at predetermined intervals vertically along border 36.

Figure 4:
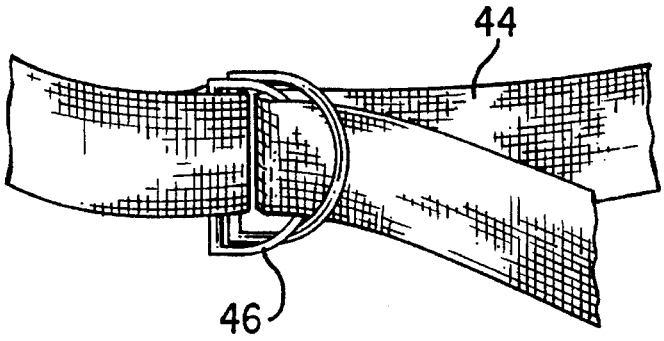
FIG. 4 is an enlarged detail of the strap device used to secure the barrier around a post.

FIG. 2 shows the attachment of barrier 22 with border 36 to post 34 by straps 44 of nylon, cotton or like material having a pair of "D" ring closures 46 of metal or plastic joined at one end, so as to form a belting device, FIG. 4 detail. Straps 44 are laced through buttonhole opening 38, wrapped around the shaft of post 34 at vertically spaced intervals, looped and pulled tightly through "D" ring closures 46 to secure barrier 22 horizontally. Strap 44 closes to the rear side of railing system 20 or away from access by children.

Figure 3:
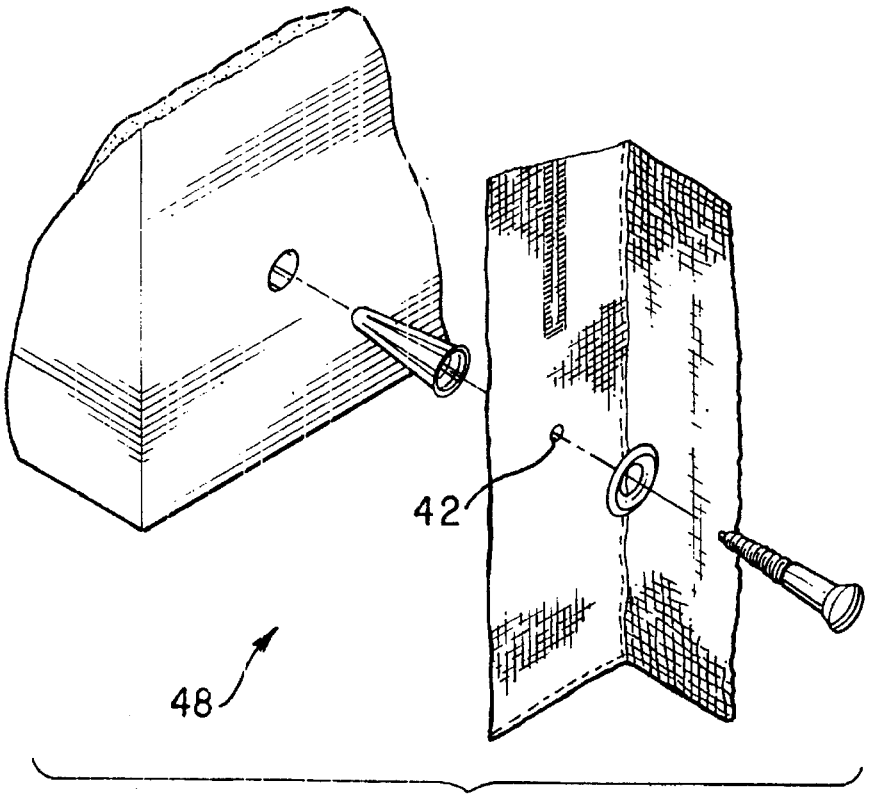
FIG. 3 is an enlarged detail showing how to secure the barrier with an anchoring screw device to a wall.

FIG. 2 also shows barrier 22 abutting end wall 32 as the alternative vertical end support. Border 36 is placed perpendicular to end wall 32 and fastened with anchoring screw devices, FIG. 3 detail, through round openings 42 so as to secure barrier 22 vertically.

Having described the basic features of barrier 22 and how they relate, consideration will now be given to the details of installation, operation and function of barrier 22 which will further clarify the intent to provide an improved and effective safety barrier for railing systems.

To prevent entrapment, serious injury, even death should passage occur through the balusters of a railing system, FIGS. 1–2 show barrier 22 installed by weaving in and out of adjacent balusters until the entire spacing between the end support structures and the top and bottom railings is substantially covered, therefore protected. The PVC composition of barrier 22 is such that it offers an inherent non-slip property when placed against the hard surface of balusters 24 and in combination with the weaving of the installation, provides a taut and effective barrier 22 that can not be manipulated by a child to the point where access is gained to potential harm. Barrier 22 is designed with simplicity and ease of installation in order to function effectively without the necessity of cording tied around the hand rail and baluster base; without cording tied to screw fasteners mounted to the floor; without stretching or otherwise losing its original shape whereby providing an escape hole and lastly, without rigid edges that could cause harm.

Borders 36 function as a reinforcing end to barrier 22 and provide the necessary holes with which to lace straps, FIG. 4 detail, through and around the shaft of post 34, as noted in FIG. 2. Straps 44 are positioned securely on post 34 shaft and when threaded through "D" ring closures 46 and pulled tightly, block the spacing defined as the area between the last baluster and end wall, preventing an escape hole for a child.

Figure 5:
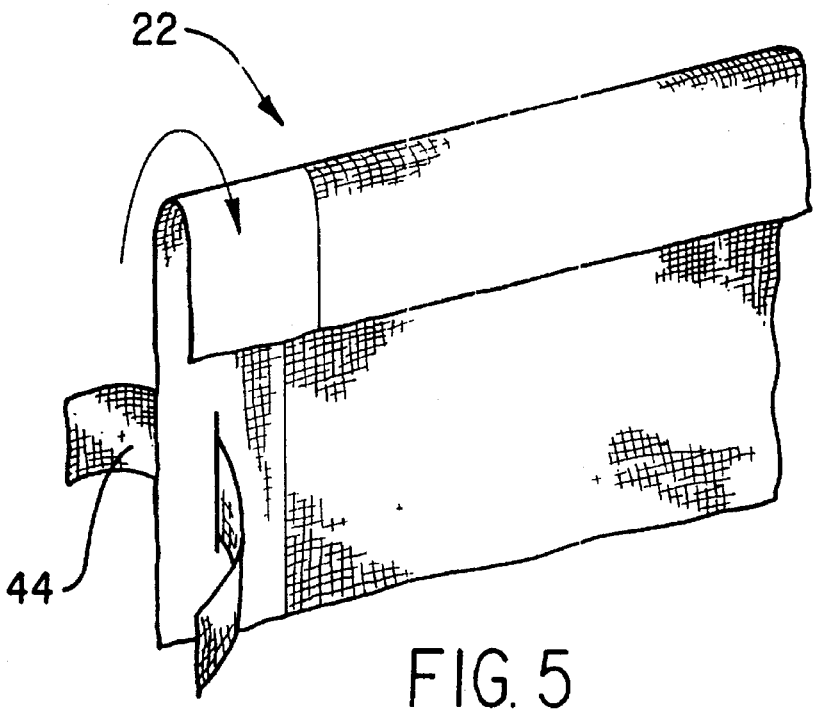
FIG. 5 is a view illustrating the height adjustability of the barrier.

FIG. 5 illustrates the ability to adjust the height of barrier 22 by rolling the PVC coated scrim under in horizontal fashion to accommodate a railing height less than the height of barrier 22. When shortened to the required height and installed around the balusters,the inherent slip-resistant property of barrier 22 stays firmly in place without additional aids for attachment.

Figure 6:
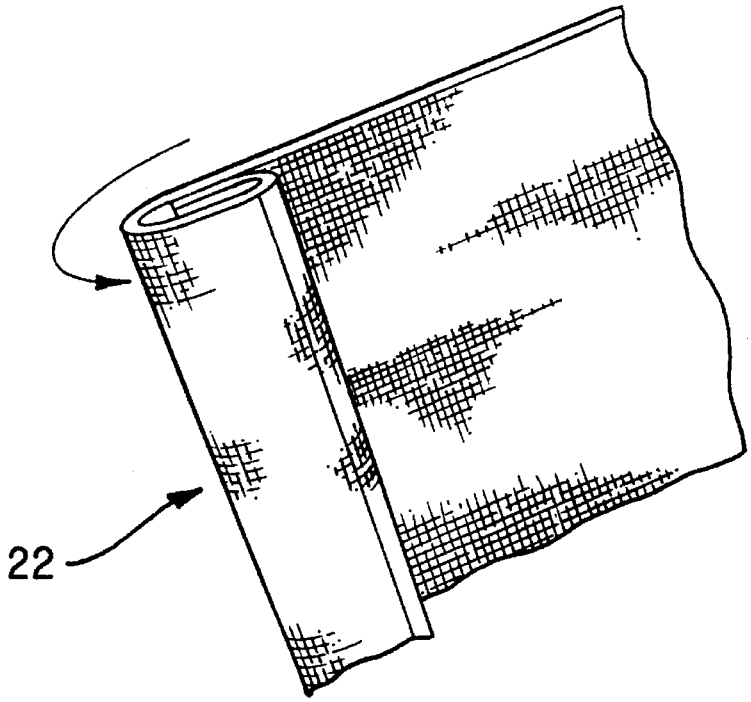
FIG. 6 is a view illustrating the length adjustability of the barrier.

FIG. 6 illustrates the ability to adjust the length of barrier 22 by rolling the PVC coated scrim in vertical fashion to accommodate a railing width less than the length of barrier 22. When the length is adjusted at border 36 closest to wall 32, FIG. 2, the PVC coated scrim of barrier 22 is rolled upon itself vertically and attached to wall 32, not shown, with anchoring screw devices 48, as detailed in FIG. 3. Anchoring screw devices 48 can be punctured manually through all thicknesses of the facing side of barrier 22, through round or punched reinforced opening 42, then through the remaining thicknesses or rear facing side of barrier 22 and attached to wall 32. When the length is adjusted at border 36 closest to post 34, the PVC coated scrim of barrier 22 is rolled upon itself vertically and straps, FIG. 4 detail, are pulled through vertical slits cut into barrier 22, substantially equal to the width of straps, FIG. 4 detail, and through all thicknesses, not shown, to allow passage and securing around post 34.

From the foregoing, it will be apparent to a person skilled in the art that a safety barrier for railing systems has been developed that will prevent harm, even death from occurring should a child attempt to penetrate all or part of the body through the adjacent balusters of the railing. The novel use of a polyester scrim coated with poly-vinyl-chloride in primary form plasticized as the basic element, installed by weaving through and along adjacent balusters until the spacing between the vertical end support structures and the top and bottom railings is substantially covered, and having material end borders and a means for joining the scrim to vertical end support structures provides a configuration which is adaptable to varying lengths and heights of railing systems.

Although only a limited number of specific embodiments have been described in detail, such description is not taken to be as a limitation of the present invention. Rather the scope of the invention is to be defined by the appended claims and their legal equivalents.

I claim:

1. A safety barrier, in combination, with a railing system having a horizontal bar supported by a plurality of spaced, vertical balusters, arranged adjacently and anchored to a floor, further supported by a pair of vertical end structures, comprising:

a) a scrim of material comprising a polyester web coated with poly-vinyl-chloride in primary form plasticized of sufficient size to guard a space between said vertical end structures and a vertical space substantially equal to the height of said balusters b) said scrim woven through the interval spacing separating said balusters to substantially cover the space between said vertical end structures and the vertical space between the horizontal bar and floor and c) means for joining said scrim vertically to said end structures so that said scrim is secured horizontally, whereby a child is prevented from entrapment or penetration through said railing system.

2. The safety barrier of claim 1 wherein said scrim has a rectangular shape.

3. The safety barrier of claim 1 wherein one of said vertical end structures comprises a post and the other comprises a wall.

4. The safety barrier of claim 3 wherein said means for joining said scrim vertically to said end structures comprises strips of reinforcing material, each of which is joined to a respective one of two vertical edges of said scrim to form a border extending along the vertical edges thereof; each having a plurality of openings positioned parallel to said edges, a plurality of flexible straps, each flexible strap having one end having a ring closure attached, the other end of each of said flexible straps extending through one of said openings on one of said vertical edges and being wrapped around said post and being threaded through each corresponding ring closure, functioning to connect and secure said scrim to said post, and wherein the other of the vertical edges of said scrim is secured to said wall by anchoring devices.

5. The safety barrier of claim 1 wherein said scrim is woven in and out of the interval spacing separating said balusters and along the full length of said railing system so as to substantially cover said spaces.

6. The safety barrier of claim 1 wherein said means for joining said scrim vertically to said end structures comprises strips of reinforcing material, each of which is joined to a respective one of two vertical edges of said scrim to form a border extending along the vertical edges thereof; each having a plurality of openings positioned parallel to said edges, a plurality of flexible straps, each flexible strap having one end having ring closures attached, the other end of each of said flexible straps extending through one of said openings and being wrapped around adjacent end structures and being threaded through each appropriate ring closure, functioning to connect and secure said scrim to said end structures.

7. The safety barrier of claim 6 wherein said reinforcing material is made of nylon.

8. A railing system, comprising, in combination:

a) a plurality of vertical balusters, spaced horizontally at predetermined intervals, anchored to flooring and supporting a horizontal hand rail, further supported by vertical end structures;

b) a safety barrier of material comprising a polyester web coated with poly-vinyl-chloride in primary form plasticized of sufficient size to accommodate an area between said vertical end structures and a vertical space substantially equal to the height of said balusters;

c) said barrier woven in and out of said balusters to substantially cover said area;

d) means for joining said barrier vertically to said end structures, whereby a secure barrier is provided to prevent a child from entrapment or penetration through said railing system.

9. The railing system of claim 8 wherein one of said vertical end structures comprises a post and the other comprises a wall.

10. The railing system of claim 9 wherein said means for joining said barrier to said vertical end structures comprises strips of reinforcing material, each of which is joined to a respective one of two vertical edges of said barrier to form a border extending along the vertical edges thereof; each having a plurality of openings positioned parallel to said edges, a plurality of flexible straps, each flexible strap having one end having a ring closure attached, the other end of each of said flexible straps extending through one of said openings on one of said vertical edges and being wrapped around said post and being threaded through each corresponding ring closure, functioning to connect and secure said barrier to said post, and wherein the other of said vertical edges of said barrier is secured to said wall by anchoring devices.

11. The railing system of claim 8 wherein said barrier is rectangular in shape.

12. The railing system of claim 8 wherein said barrier is woven by winding said barrier in and out of adjacent balusters and along the full length of said railing system so as to substantially cover said area.

13. The railing system of claim 8 wherein said means for joining said barrier to said vertical end structures comprises strips of reinforcing material, each of which is joined to a respective one of two vertical edges of said barrier to form a border extending along the vertical edges thereof; each having a plurality of openings positioned parallel to said edges, a plurality of flexible straps, each flexible strap having one end having a ring closure attached, the other end of each of said flexible straps extending through one of said openings and being wrapped around adjacent end structures and being threaded through each corresponding ring closure, functioning to connect and secure said barrier to said end structures.

14. The railing system of claim 13 wherein said reinforcing material is made of nylon.

15. A method for installing a safety barrier in combination with a railing system constructed of a plurality of vertical balusters spaced at predetermined intervals, anchored to a floor and supporting a horizontal bar, further supported by vertical end structures and providing a scrim of material comprising a polyester web coated with poly-vinyl-chloride in primary form plasticized and means for joining said scrim to said vertical end structures, said method comprising the steps of:

a) providing and positioning said scrim so that one vertical edge is substantially joined to one of said vertical end structures, and b) weaving said scrim through the interval spacing separating said balusters, and c) positioning the opposite vertical edge of said scrim so that the opposite vertical edge is substantially joined to the other of said vertical end structures, whereby a secure, reliable guard is installed on said railing system to prevent entrapment therein or penetration therethrough.

16. The method of claim 15 wherein said weaving is performed by alternating said scrim between said interval spacing of adjacent balusters and along the full length of said railing system so that an area defined as a space between said vertical end structures and a vertical space substantially equal to the height of said balusters is protected.

* * * * *